US006731053B2

(12) United States Patent
Chen

(10) Patent No.: US 6,731,053 B2
(45) Date of Patent: May 4, 2004

(54) LAMP WITH LIGHT EMITTING DIODES

(75) Inventor: Yi-Yi Chen, Tainan (TW)

(73) Assignee: Innovative & Superior Technologies Inc., Hsin-Chu (TW)

( * ) Notice: Subject to any disclaimer, the term of this patent is extended or adjusted under 35 U.S.C. 154(b) by 61 days.

(21) Appl. No.: 10/241,770

(22) Filed: Sep. 12, 2002

(65) Prior Publication Data

US 2004/0051434 A1 Mar. 18, 2004

(51) Int. Cl.[7] ..... H01J 5/48
(52) U.S. Cl. ..... 313/318.01; 313/512
(58) Field of Search ..... 313/318.01, 512

(56) References Cited

U.S. PATENT DOCUMENTS 5,808,592 A * 9/1998 Mizutani et al. ..... 313/512

6,234,648 B1 * 5/2001 Borner et al. ..... 313/512

* cited by examiner

*Primary Examiner*—Vip Patel
(74) *Attorney, Agent, or Firm*—Rosenberg, Klein & Lee

(57) ABSTRACT

A lamp includes a base, light emitting diodes and a transparent covering unit. The base has a convexly curved surface. The transparent covering unit has a convexly curved surface on a first side, and several outwardly facing flat sections on an opposite second side, which is faced with the convexly curved surface of the base. The light emitting diodes are arranged on the convexly curved surface of the base to be each perpendicular to a corresponding one of the flat sections; thus, light emitted from the light emitting diodes can be refracted to focus when passing through the transparent covering unit, providing increased illumination.

2 Claims, 5 Drawing Sheets

LAMP WITH LIGHT EMITTING DIODES

BACKGROUND OF THE INVENTION

1. Field of the Invention

The present invention relates to a lamp having light emitting diodes, more particularly a lamp having light emitting diodes capable of being focused to provide increased illumination.

2. Brief Description of the Prior Art

Light emitting diodes can produce light when powered by low voltage therefore they consume less electricity. Many efforts are made to improve light emitting diodes so that they can be used as economical illuminating devices in the illumination industry.

However, conventional lamps with light emitting diodes are not equipped with such a device that can effect refraction and reflection of the light emitted from the light emitting diodes, i.e. the light passes directly through the hole of a panel to provide illumination. Consequently, the light of such lamps is not very bright; therefore the lamps have limited use.

SUMMARY OF THE INVENTION

It is a main object of the present invention to provide such a lamp having light emitting diodes that light emitted from the light emitting diodes can be refracted to focus to provide increased illumination.

The lamp includes a base, and a transparent covering unit. The base has a convexly curved surface. The transparent covering unit has a convexly curved surface on a first side, and several flat sections on an opposite second side. The transparent covering unit is disposed near to the base with the second side thereof being faced with the convexly curved surface of the base. The light emitting diodes are arranged on the convexly curved surface of the base to be each perpendicular to a corresponding one of the flat sections.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
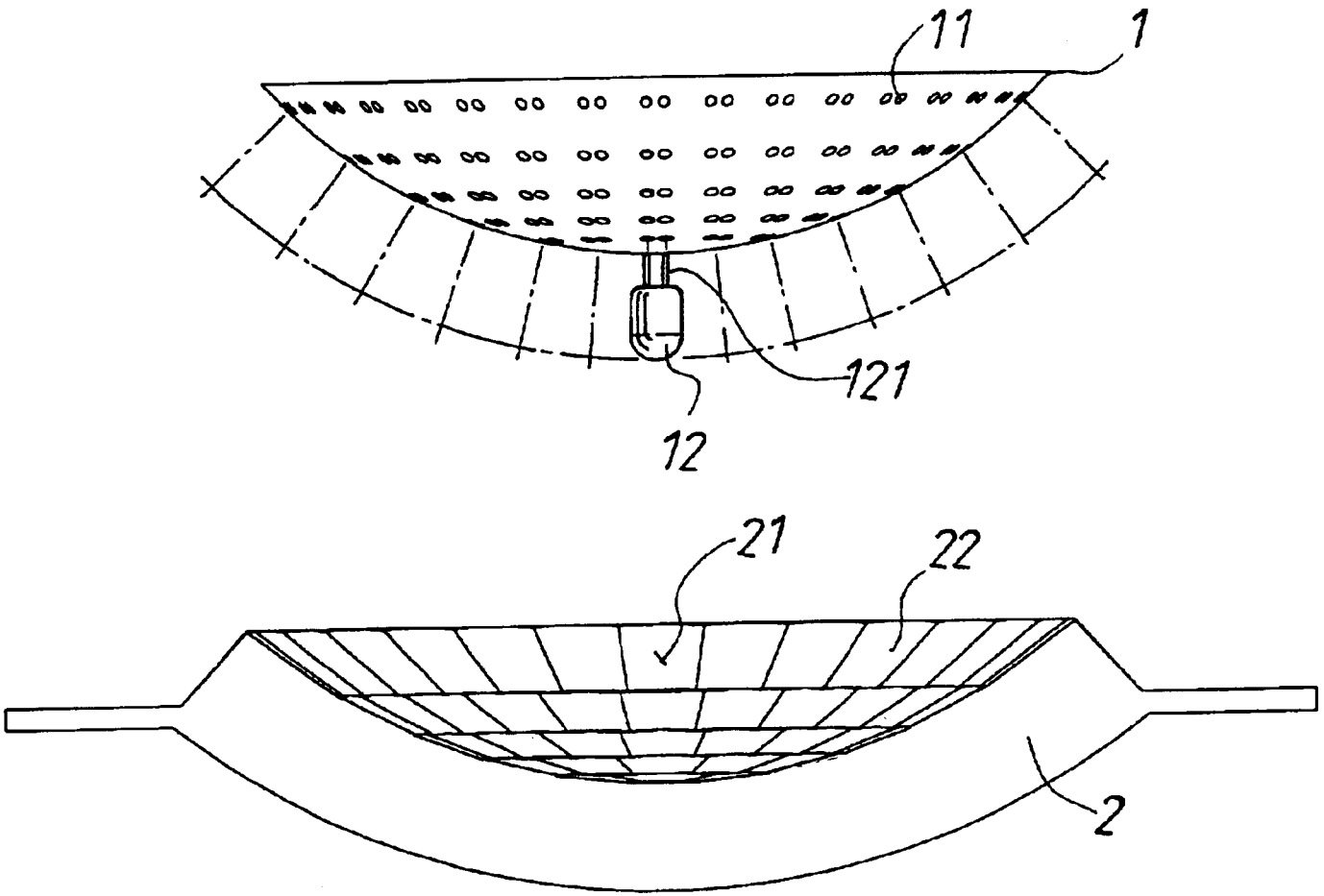
FIG. 1 is an exploded side view of the lamp with light emitting diodes of the first embodiment of the present invention.

Referring to FIG. 1, a lamp with light emitting diodes of a first embodiment of the present invention has a base 1, a transparent covering unit 2, and several light emitting diodes 12.

The base 1 has a convexly curved surface, and terminals 11 spaced thereon.

The transparent covering unit 2 has a convexly curved surface on a first side, and has holding rooms 21 on an opposite second side thereof. Each of the holding rooms 21 is formed with a flat section 22 to face outwardly of the covering unit 2.

Figure 2:
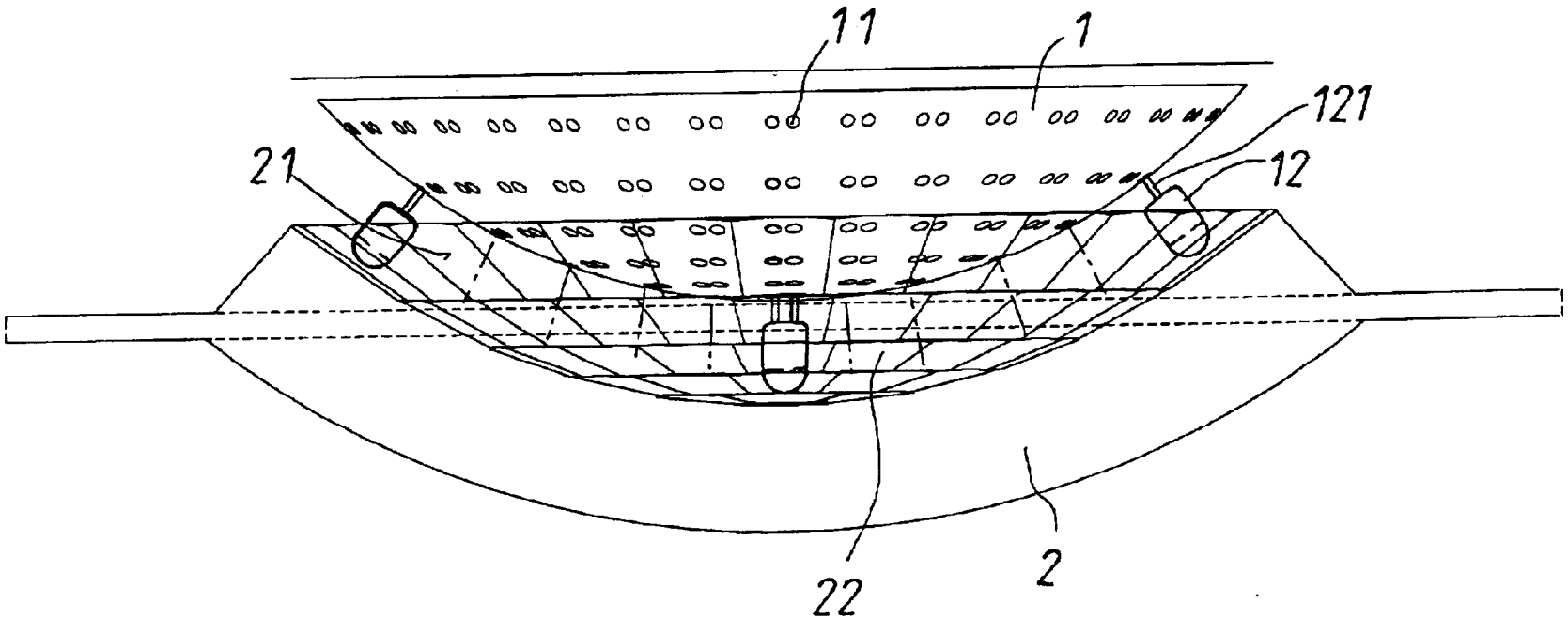
FIG. 2 is a side view of the lamp with light emitting diodes of the first embodiment of the present invention.
Figure 3:
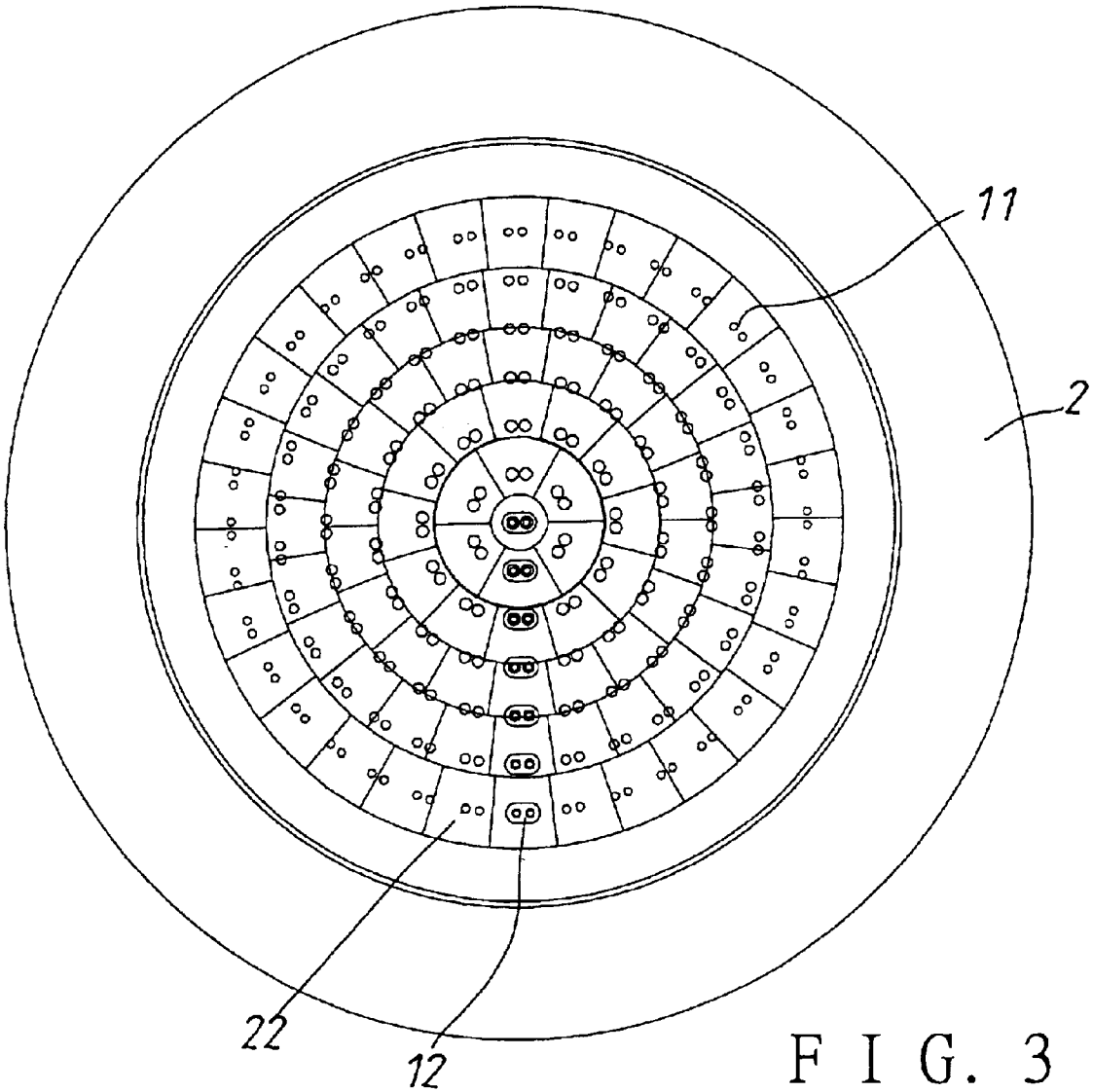
FIG. 3 is a top view of the lamp with light emitting diodes of the first embodiment of the present invention.
Figure 4:
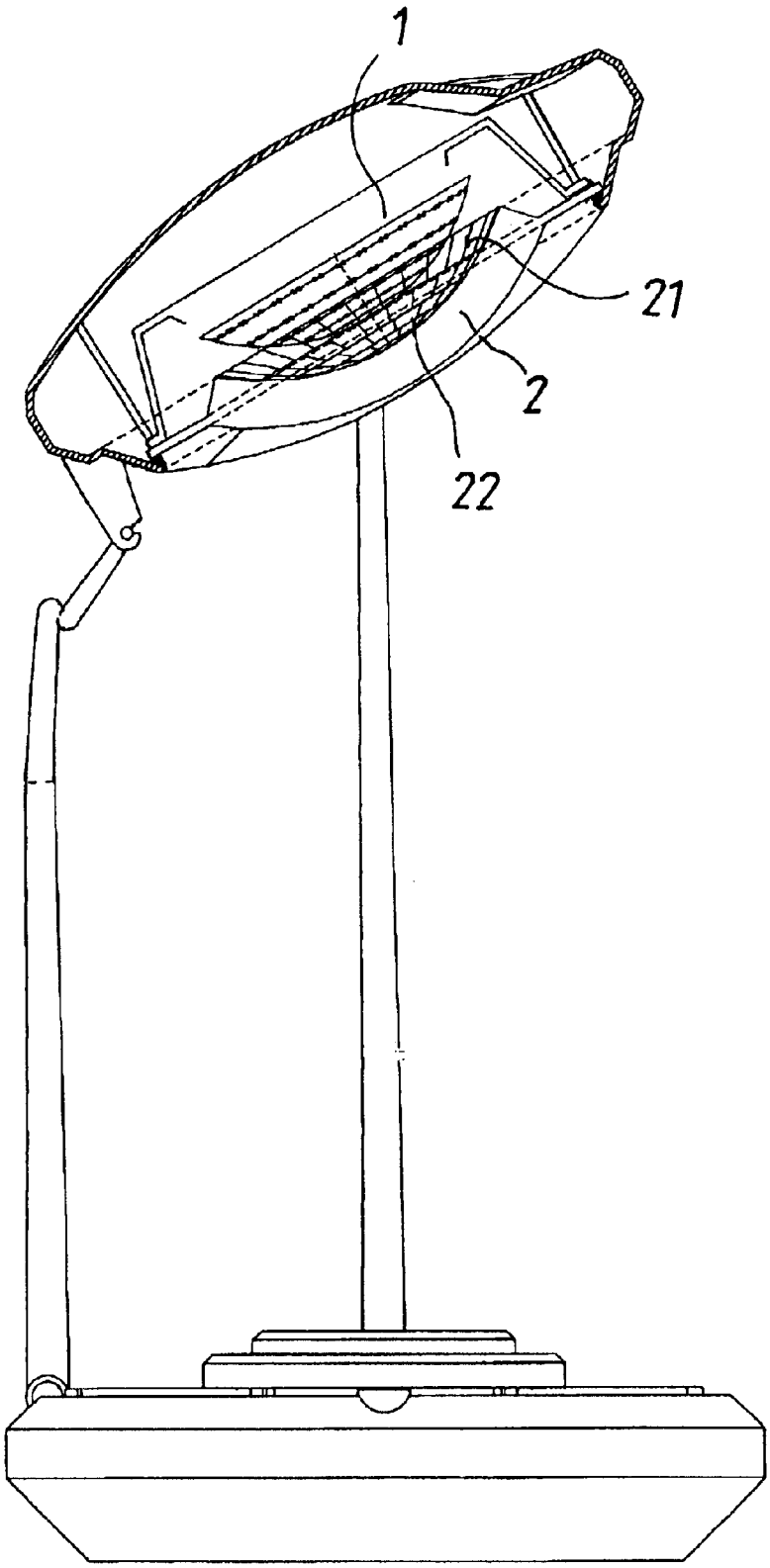
FIG. 4 is a view showing the way to use the lamp with light emitting diodes of the first embodiment of the present invention.

Referring to FIGS. 2 and 3, the transparent covering unit 2 is disposed near to the base 1 with the second side thereof being faced with the convexly curved surface of the base 1. And, the light emitting diodes 12 are disposed on the convexly curved surface of the base 1 with connecting legs 121 thereof being inserted into the terminals 1. In addition, the light emitting diodes 12 are each positioned in a corresponding one of the holding rooms 21 in such a manner as to be perpendicular to the corresponding flat section 22.

Thus, light emitted from the light emitting diodes 12 can be refracted to focus when passing through the transparent covering unit 2.

Figure 5:
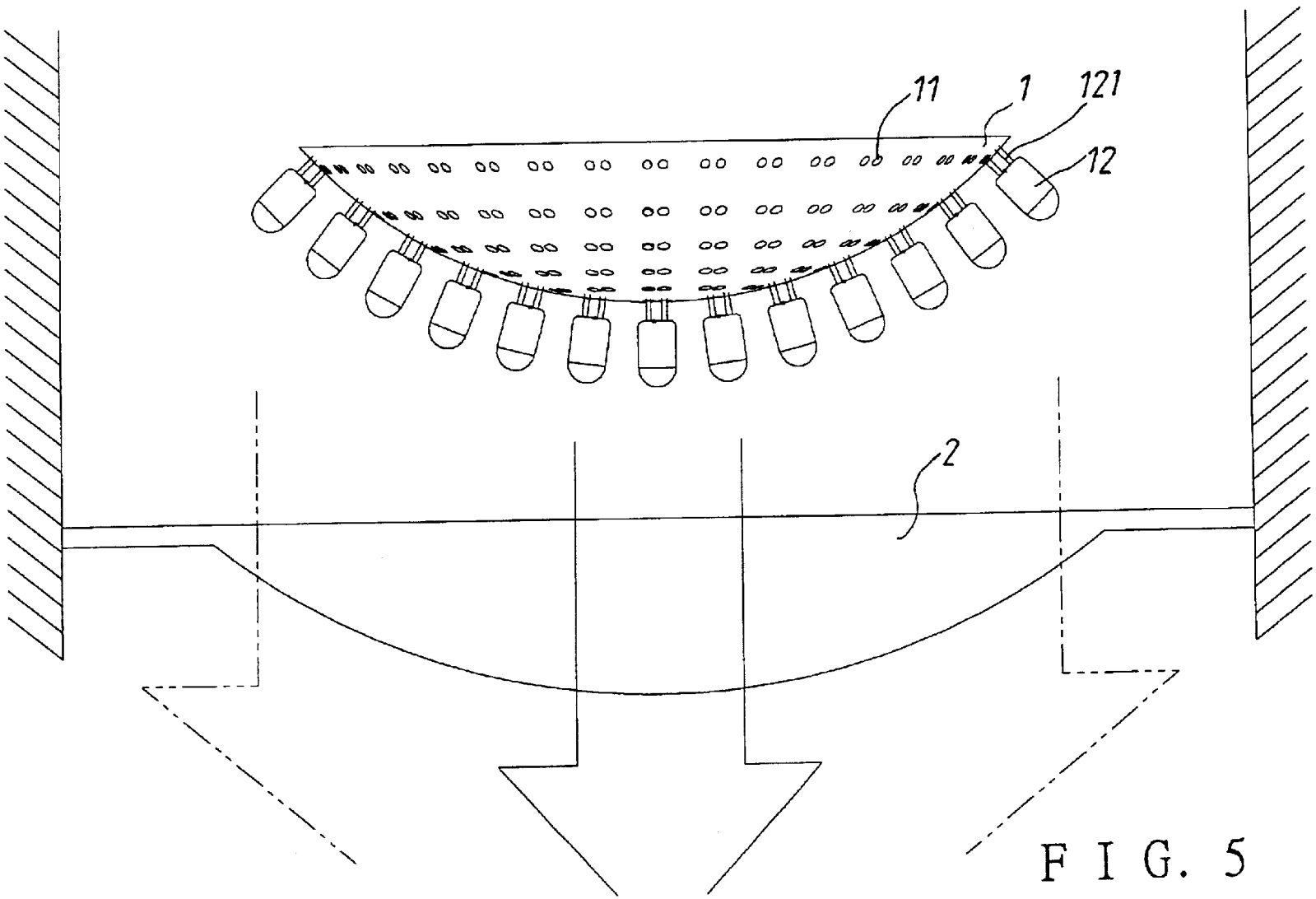
FIG. 5 is an exploded side view of the lamp with light emitting diodes of the second embodiment of the present invention.

Referring to FIG. 5, a lamp with light emitting diodes of a second embodiment of the present invention is provided with an one-sided convex lens instead of the transparent covering unit 2. In other words, the lamp of the second embodiment has a transparent covering unit that includes both a convexly curved side and a flat side. Therefore, light emitted from the light emitting diodes 12 can be refracted to focus when passing through the lens.

From the above description, it can be easily understood that because the transparent covering unit refracts the light for the same to be able to focus, the lamp according to the present invention can provide increased illumination with certain power consumption.

What is claimed is:

1. A lamp with light emitting diodes, comprising a base having a convexly curved surface;

a transparent covering unit having a convexly curved surface on a first side, and being faced with the convexly curved surface of the base on an opposite second side thereof; the second side of the transparent covering unit being formed with a plurality of flat sections;

a plurality of light emitting diodes arranged on the convexly curved surface of the base to face the second side of the transparent covering unit; the light emitting diodes being each positioned in such a way as to be perpendicular to a corresponding one of the flat sections;

whereby light emitted from the light emitting diodes can be refracted to focus when passing through the transparent covering unit.

2. The lamp with light emitting diodes as claimed in claim 1, wherein the second side of the transparent covering unit being formed with a single flat surface instead of the plural flat sections.

* * * * *